United States Patent [19]

Cunnington

[11] 4,373,444

[45] Feb. 15, 1983

[54] LABEL WEB OVER-PRINTER

[75] Inventor: Harry Cunnington, Boston, England

[73] Assignee: Norcros Investments Limited, Reading, England

[21] Appl. No.: 201,275

[22] Filed: Oct. 27, 1980

[30] Foreign Application Priority Data

Oct. 31, 1979 [GB] United Kingdom ..... 7937804

[51] Int. Cl.[3] ..... B41F 5/00; B41F 13/04

[52] U.S. Cl. ..... 101/228; 101/367; 101/247

[58] Field of Search ..... 101/228, 377, 92, 66, 101/67, 331, 367, 348

[56] References Cited

U.S. PATENT DOCUMENTS

| | | | |
|---|---|---|---|
| 679,627 | 7/1901 | Leavy et al. | 101/92 |
| 1,750,357 | 3/1930 | Ramdor | 101/228 |
| 2,041,831 | 5/1936 | Helsel | 101/228 X |
| 2,250,677 | 7/1941 | Paulsen | 101/228 |
| 2,671,397 | 3/1954 | Gorbatenko | 101/228 |
| 2,996,001 | 8/1961 | Schlegel et al. | 101/228 X |
| 3,453,952 | 7/1969 | Huber | 101/91 |
| 4,092,920 | 6/1978 | Barnak | 101/92 X |

FOREIGN PATENT DOCUMENTS

| | | | |
|---|---|---|---|
| 218087 | of 1968 | Sweden | 101/92 |

*Primary Examiner*—Edgar S. Burr
*Assistant Examiner*—Charles Pearson
*Attorney, Agent, or Firm*—Leydig, Voit, Osann, Mayer & Holt, Ltd.

[57] ABSTRACT

An over-printer comprises a label web support reel, an inking roller and a type drum. The type drum co-operates with a rotary platen which is freely rotatable on a shaft. The type drum and the platen have concentric cams which serve to index a web of labels through the printing station, the cam of the type drum being secured for rotation therewith.

The inking roller is built up from a multiplicity of absorbent paper discs and the type drum has one arcuate recess to receive type rails and at least one cylindrical recess to receive an adjustable facet printing mechanism.

Can be used for printing label and other webs.

1 Claim, 15 Drawing Figures

LABEL WEB OVER-PRINTER

BACKGROUND OF THE INVENTION

1. Field of the invention

The invention relates to over-printers and other printing machines.

2. Summary of the prior art

For certain articles such as labels, it is sometimes a requirement to print additional information on a label already previously printed with basic information. This basic information may, for example, be the name of a merchant supplying the articles and the overprinting may be required to give details of particular articles such as the price, stock code, date limits for use and so on. Over-printers which satisfy these general requirements have been known for many years and in general terms operate satisfactorily.

It is, however, desirable to provide an over-printer which satisfies all the basic requirements for such a machine with a minimum of complexity with consequent cost savings but a maximum of flexibility in the mode of use allied with high print quality. While bearing these requirements in mind it is also, as a general aim for all new technology to reduce the cost of maintainance, to provide for ease of repair and good long-term performance.

It is therefore an object of the present invention to provide an improved over-printer.

SUMMARY OF THE INVENTION

In a lable over-printer a label web reel holder, a frame of the over-printer mounting the reel holder, guide means for guiding the label web from the reel, a releasable brake pad operative on the upper face of the label web as it is drawn from the reel through the guide means, adjustable guide means adjacent one edge of the web, a printing mechanism downstream of the guide means including a rotary type drum haing extruded groups of rails for receiving printing indicia accommodated in at least one axially-extending recess in the periphery of the drum, a rotarty platen freely-rotatable and co-operating with the type drum, means eccentrically mounting the platen whereby printing pressure between the type drum and the platen can be adjusted, cam means secured for rotation and co-axial with the type drum, further cam means synchronously driven in the opposite sense of the cam means of the type drum and arranged to co-operate therewith to index the web intermittently through the printing mechanism and an ink roller co-operating with said printing indicia, said roller incorporating a multiplicity of discs of ink-absorbent paper arranged as a stack, and means at each end of the stack clamping the discs together, reciprocating indexing means for providing fine adjustment of the indexing stroke of the label web through the over-printer, guide rollers operable on the printed web of labels after the printing mechanism, a web take-up reel mounted on the frame after the said guide rollers, and means for positively driving said take-up reel to wind the printed web on the reel.

DESCRIPTION OF THE PREFERRED EMBODIMENT

Figure 1:
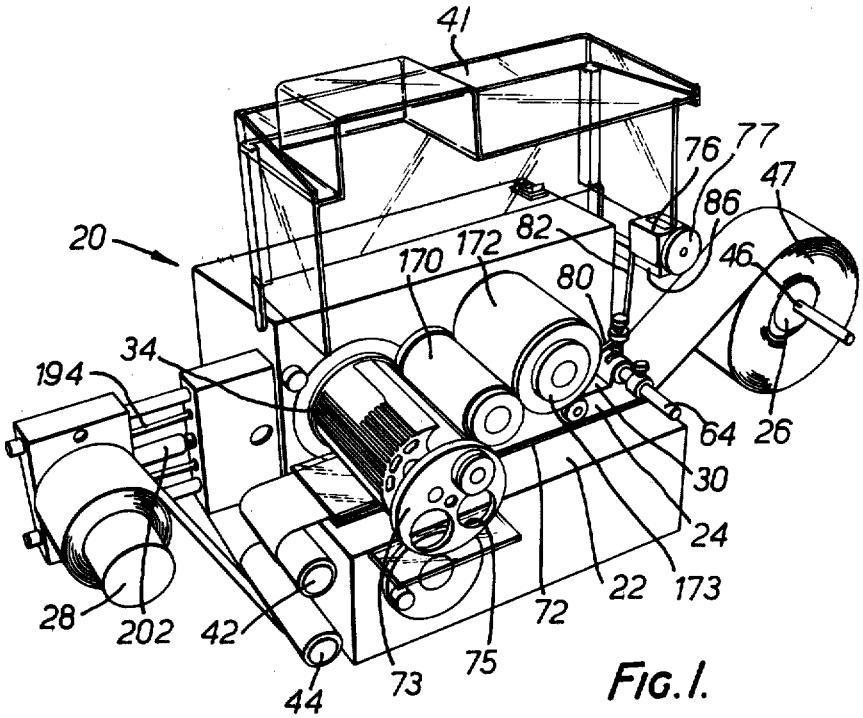
FIG. 1 is a perspective view of the over-printer from one angle.
Figure 2:
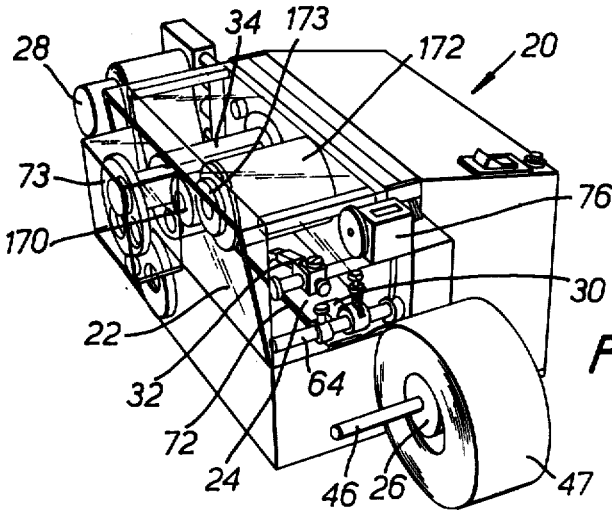
FIG. 2 is a perspective view of the over-printer taken from another angle.

Referring now to the drawings, and in particular to the general arrangement illustrated in FIGS. 1 and 2, the over-printer in the preferred embodiment includes a frame (not shown) with a casing 20, part of which houses a drive motor and associated gearing (not shown) the other part of which provides an upper surface 22 for a label web 24 during its passage from a storage reel-holder 26 at one end of the over-printer to a driven take-up reel holder 28 disposed beyond the casing which is readily detachable for replacement by a cutter device when it is desired to sever the web into individual labels or groups of labels instead of effecting rewinding after over-printing has been completed.

The label web 24 druing its path from the storage reel to the take-up reel (or to the cutter device where appropriate) includes a drag brake 30 which can be released for threading purposes), a claw member 32 downstream of the drag brake 30, a rotary type drum 34 co-operating with a free-wheeling, cylindrical, roller platen 36 below the level of the casing surface 22, both the type drum 34 and the freely-rotating platen 36 (FIG. 8) being associated with respective co-axial cams 38, 40 which cams both co-operate with an edge portion of the label web 24 to index the label web intermittently through the over-printer. The co-axial arrangement of the cams with the drum and platen saves space and simplifies the drive to these parts.

Downstream of the printing station there are two guide rollers 42, 44 one lying immediately adjacent to the downstream edge of the casing 20 and the other being below the level of that edge and also below the level of the take-up reel holder 28.

Having described the machine in general outline the details will be described primarily in relation to the remaining Figures.

The storage reel holder 26 takes the form of a simple bracket and steel rod 46 which carries a reel 47 and an end-stop to prevent the reel moving off the end of the rod during operation.

Figure 4A:
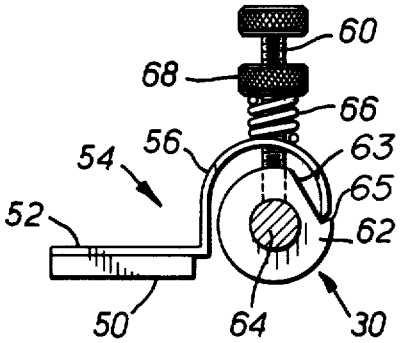
FIGS. 4*a* and 4*b* show respectively a side elevation and a plan view of a drag brake of the over-printer operative on a label web.
Figure 4B:
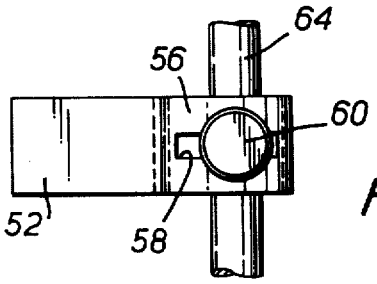

The drag brake 30 (FIGS. 4*a* and 4*b*) comprises a pad of felt 50 which frictionally but slidably engages the web and is carried by a rectangular portion 52 of a pressed steel member 54 which also includes an arcuate part 56 upstanding from one end of the rectangular portion. The arcuate portion has a slot 58 which receives a screw 60, the end portion of which is screwed into a disc 62 mounted on a transverse shaft 64 and the screw 60, which is spring-loaded by a spring 66, is movable between a position in which the disc 62 acts to apply force to the pad and a position in which that force is released and the pad allows free movement of the web beneath it. The force applied by the spring 66 is adjustable by varying the position of a nut 68. The disc 62 has a flat 63 with a stop 65 at one end which normally engages the free end of the arcuate part 56.

The shaft 64 carrying the drag brake 30 also carries one end of fixing menas for guide means for guiding the label web from the reel in the form of an elongate guide 72 (FIGS. 1 and 2) of channel section lying with its limbs horizontal which lightly engages an edge portion of the web downstream of the shaft 64 up to a position closely adjacent to the printing station.

Figure 9A:
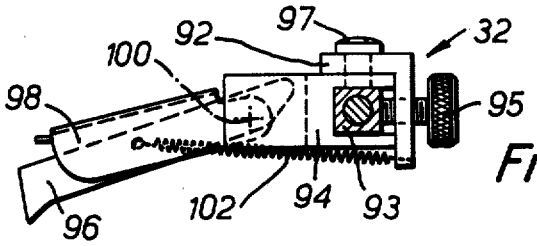
FIGS. 9*a* and 9*b* are respectively a side elevation and a plan view of a claw member which assists in the indexing of the label web through the over-printer.
Figure 9B:
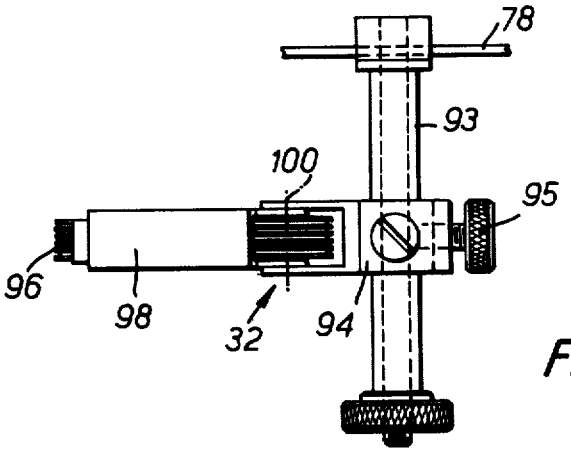

A counter 76 is operated by a reciprocating slide 78 (FIG. 9*b*) which moves with forward movement of the label web and serves at the rear end of its stroke to move a short lever 80 pivoted about the shaft 64, motion of this lever 80 serving to actuate a rod 82 which in turn trips the conventional counter mechanism 76 mounted on a bracket 86 of the main casing of the machine. A re-set knob 77 is provided to zero the counter when required.

The slide 78 also carries the claw assembly 32 and serves to move it synchronously with motion of the label web.

The claw assembly 32 includes an angle-section bracket 92 by which it is adjustably mounted on the slide 78, and a square section member 93 carrying a clevis member 94 which, in turn, carries at its end remote from the bracket a pivotal claw member 96. The claw member 96 is clamped adjustably to the member 93 by set screws 95 and 97. The claw member 96 is supported in an inverted, channel-section, part 98 and this part 98 is pivoted by a pin 100 to the clevis 94. A helical tension spring 102 is attached to the lower edge of the bracket 92 and also to the channel-section part 98 to provide an "over-centre" action enabling the claw member 96 to be retracted from the web. The claw is built up from a plurality of thin sheet metal parts independent of one another so that if the labels are divided by perforations the tips of the individual parts will engage in the perforations. The purpose and operation of the claw member will be described hereinafter.

Figure 5:
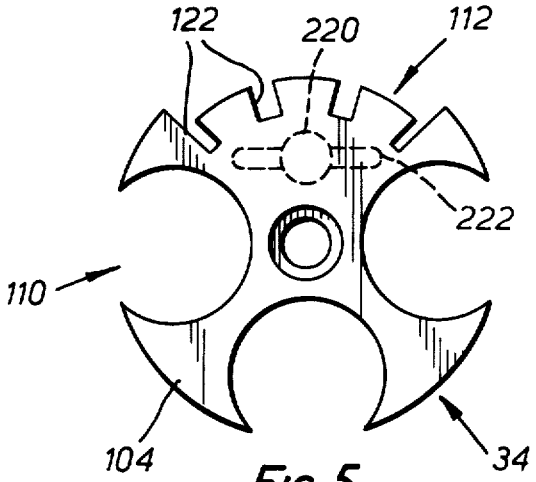
FIG. 5 is an end view of a type drum as incorporated in the over-printer of FIGS. 1 and 2.
Figure 6A:
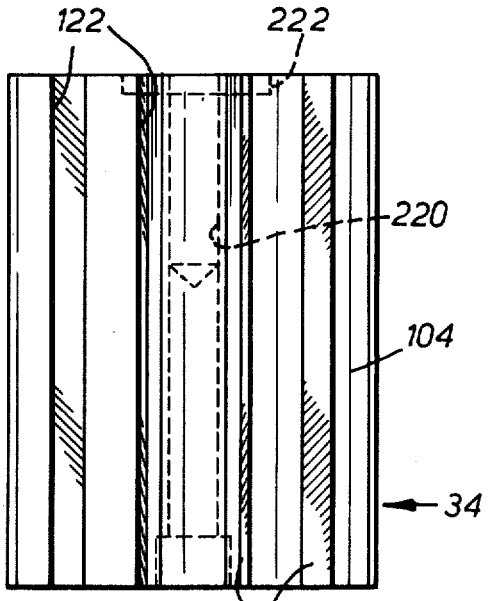
FIG. 6*a* is a plan view of the type drum of FIG. 5.
Figure 6B:
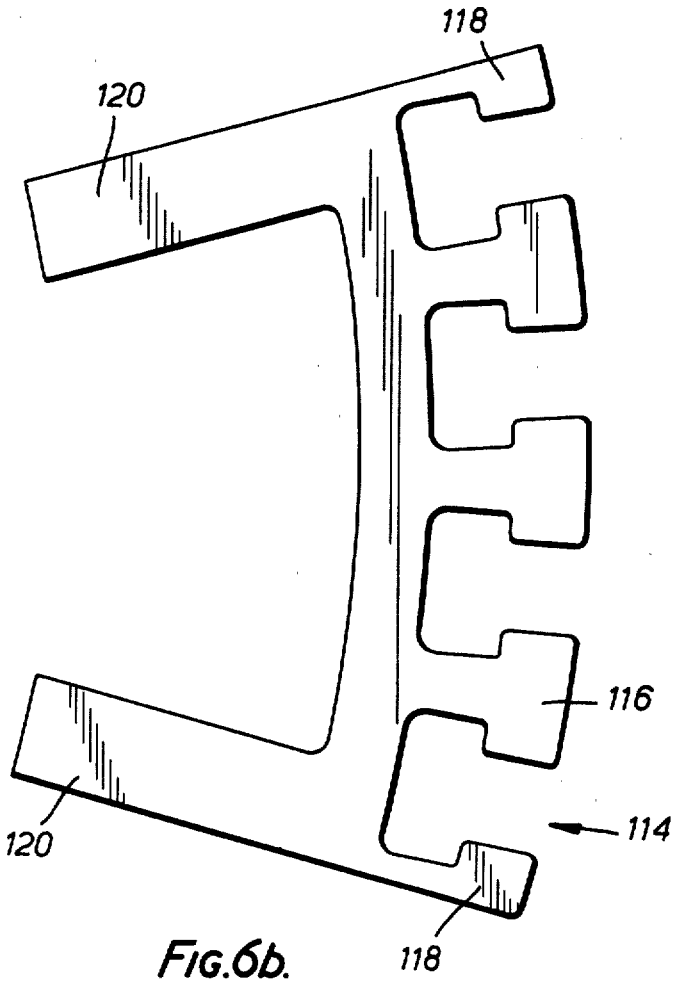
FIG. 6*b* is an end elevation of a single group of extruded rails for use in the type drum.
Figure 7B:
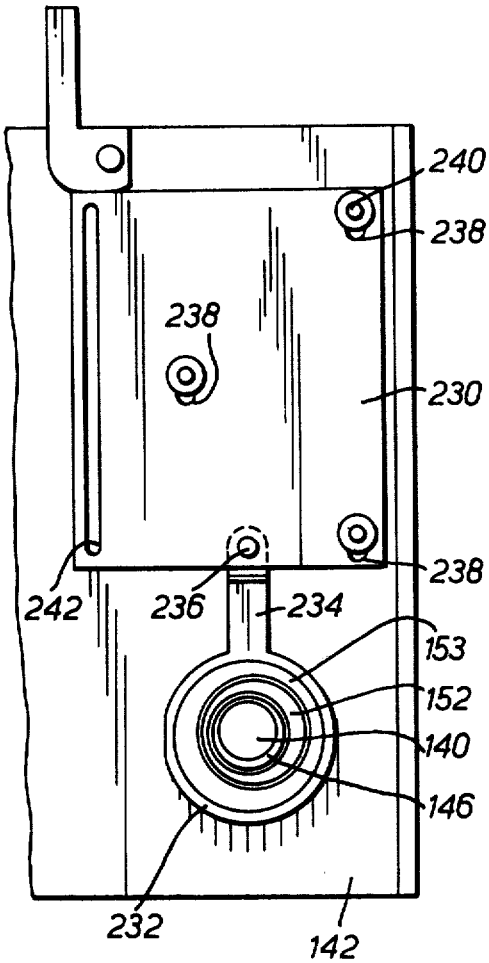
FIGS. 7*a* and 7*b* are respectively a plan view and a side elevation illustrating a mechanism which serves to match exactly the advance of the label web to the label length.
Figure 7A:
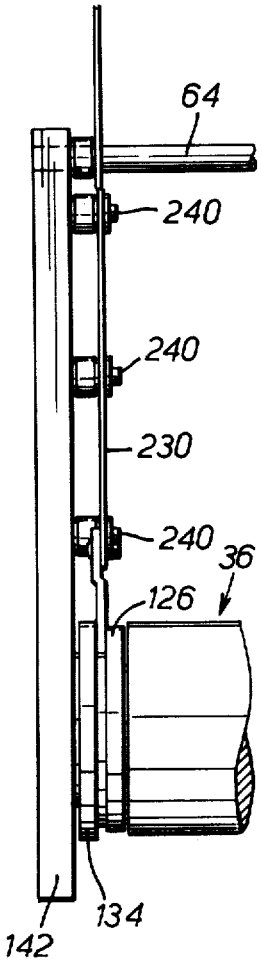

The type drum shown in FIGS. 5 and 6 is continously rotatable by the drive motor (not shown) through gearing within the main casing and includes a machined aluminium body 104 having three part-cylindrical bores 110 extending axially and each of these bores may receive an adjustable facet printing mechanism (not shown) which will include a member for adjusting the print facets operative at any given setting. This mechanism also includes read-out characters so that an operator can readily appreciate the print facets operative at any given setting. Such adjustable facet print mechanisms are generally known and will not be described herein in detail.

In addition to the three part-cylindrical bores, an arcuate recess 112 is also provided which accommodates two or three groups 114 of cliche-carrying rails 116 which, in contrast to conventional type drums, are extruded as single pieces and then engaged in the recess 112. As will be apparent, each group 114 includes three full-size rails 116 and two half-size rails 118, each of which half-size rails in the assembled condition is matched to the adjacent half-rail to form a complete rail. The cross-sectional shape of the individual rails is conventional and will not be further described, and as is conventional, the rails engage complementary shaped recesses of the cliches or print block. Each extruded group of rails 114 has two inwardly-extending, elongate, dovetail, projections 120 which each engage in a corresponding slot 122 of the drum. The two central slots each accommodate two projections 120.

The overhung type drum 34 abuts at the end adjacent to the casing the cam 38 (FIG. 8) which has a nose 126 extending over approximately 180° and this cam co-operates with the generally similar cam 40 coaxial with the rotary platen 36 freely rotatably mounted below the surface 22 of the casing which carries the web. An aperture is provided in the upper surface of the casing 20 to enable the two cam noses 126 to co-operate with an edge portion of the label web and thus to index the latter through the machine by a basic distance.

Figure 8:
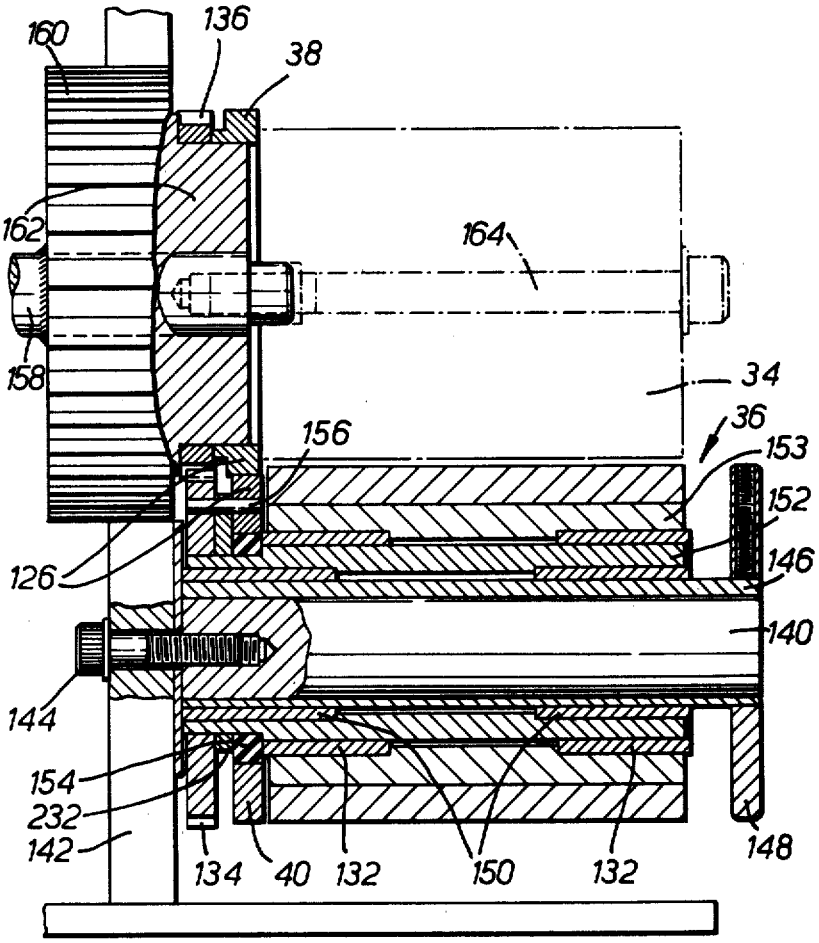
FIG. 8 is a longitudinal section showing details of the printing platen which co-operates with the type drum and cliches mounted thereon.

The platen shown in FIG. 8 is freely-rotatable on bearings 132 and this rotation is completely independent of rotation of the corresponding cam 40 which is driven positively by a gear wheel 134 which meshes with a gear wheel 136 driving the type drum 34.

The rotary platen 36 is supported basically on a cantilever shaft 140 mounted on a vertical frame member 142 by a bolt 144 engaged in a tapped bore in one end of the shaft. The shaft carries an eccentric sleeve 146 rigid, at the end remote from the frame member 142 with a setting disc 148 graduated to indicate the distance between the rotary platen and the type drum these parts thus serving as means for monitoring the pressure between the rotarty printing mechanism and the rotary platen. A locking device (not shown) is provided to lock the sleeve 146 in its selected adjustment position. At each end portion, the eccentric sleeve 146 supports two plain bearings 150 which are partially received in recesses in a further eccentric sleeve 152. The latter carries the bearings 132 which enable an outer sleeve 153 to rotate freely together with the platen 36. The left-hand end portion (as shown) of the further sleeve 152 has a shoulder against which is applied a hard rubber ring 154 which carries outwardly thereof the cam 40.

The cam 40 is made fast for rotation with the gear wheel 134 by means of one or more pins 156. The type drum 34 is supported on a shaft 158 driven by a motor (not shown) and this shaft is rotatably supported in a bearing 160 through the intermediary of a stepping cylindrical member 162. The smaller diameter portion supports the gear 136 and also the web-advancing cam 38. The type drum is secured to the shaft 158 by a set bolt 164 (chain lines).

Figure 3:
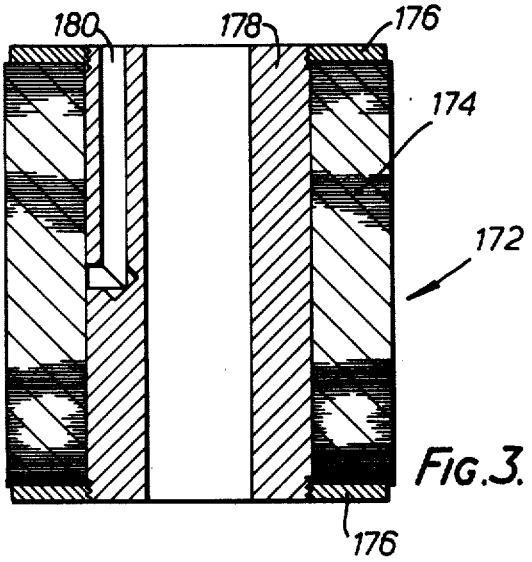
FIG. 3 is a longitudinal section through a rotary inking pad incorporated in the over-printer of FIGS. 1 and 2.

The cliches or block and the adjustable facet print devices mounted on the type drum receive ink from a transfer roller 170 (FIG. 1) which is driven by internal gearing (not shown) which also meshes with the drive gearing (not shown) of the type drum 34 to achieve synchronous operation. The ink transfer roller 170 is itself provided with a supply of ink from an inking roller 172, which in the preferred embodiment is built up from a stack of five hundred and thirty paper discs 174 (FIG. 3) which are clamped lightly together by metal end-discs 176 threaded on to a hollow internal spindle 178.

The paper selected will be of an absorbent quality so that a maximum of quantity of ink can be stored and the pressure applied by disc 176 will be such that the absorbent quality of the paper is not impaired. The inking roller 172 can be readily detached by a simple locking device 173 at the end of the spindle and fresh supply of ink can be supplied to the internal periphery of the discs through a passage 180 in the spindle, the interior of the spindle being readily accessible once the end locking device 173 has been slackened and the inking roller removed.

Figure 10:
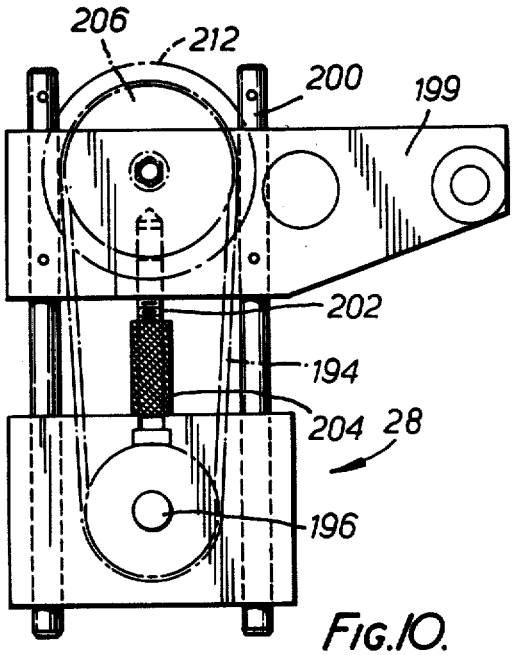
FIG. 10 is a side elevation of a readily-detachable web take-up reel assembly.
Figure 11:
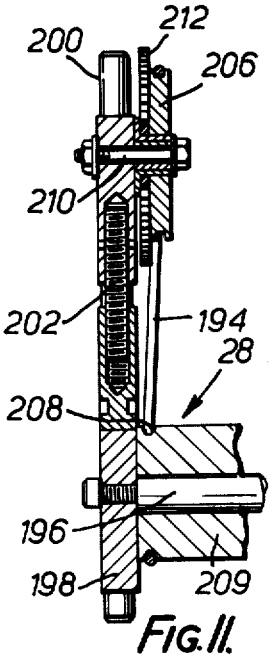
FIG. 11 is a section of the assembly of FIG. 10.

Downstream of the type drum 34 and printing platen 36 the label web is first pased over the freely-rotatable rubber covered roller 42 mounted adjacent to the downstream edge of the casing and then under the second roller 44 mounted well below the first roller before it is passed to the driven take-up reel 28, the drive being provided by a light band 194 (FIGS. 10 and 11) driven synchronously with the type drum 34. The take-up reel spindle 196 is mounted on a frame 198, 199 carrying two horizontal rod members 200 which engage corresponding receiving holes in the main casing, and grub screws (not shown) are provided to secure these horizontal rails in position.

The two-part frame 198, 199 of pressed sheet metal is spaced apart by the two rod members 200 and this distance is controlled by a screw and nut assembly 202, 204 so that the band 194 can be appropriately tensioned. The band 194 is trained around a pulley 206 and engages in a groove 208 at one end of the take-up reel mounting 209. The pulley 206 is driven on its spindle 210 by a gear wheel 212 which meshes with a gear wheel (not shown) forming one part of the drive system within the casing.

If it is desried to cut the label web into individual label pieces, the take-up reel assembly is replaced by a similar construction although in this instance the cutter is driven by a gear wheel which drives the cutter blade through a rod mounted eccentrically on a disc.

Referring now to FIGS. *7a* and *7b* a reciprocating plate 230 which supports the shaft 93 (FIGS. *9a* and *9b*) of the claw member 96 is controlled by an eccentric 232 having an extension 234 pivoted at 236 to the plate and the plate has three slots 238 each mounted on a pin 240 rigid with the plate 142. The reciprocating plate 230 has an elongate slot 242 to enable the shaft 93 to be adjusted to take into account label length. As is apparent from FIG. 8 the eccentric 232 lies between the cam 40 and the gear wheel 134.

For test purposes it may be desirable to drive the machine manually and to enable this to be effected without difficulty, the free end face of the type drum has a bore 220 (FIG. *6a*) and a transverse slot 222 which receives a complementary cranked handle. Rotation of the handle causes rotation of the type drum which, through the gearing and/or light band drives all the remaining parts of the printer.

Operation of the over-printer is believed clear from the foregoing description, but a brief summary will nevertheless be given of the mode of operation. A reel 47 of labels is mounted on spindle 46 and a length of label web threaded beneath the drag brake 30 in its raised condition, beneath the claw member 96 (again in its raised condition) through the nip defined by the type drum 34 and the platen 36, over the roller 42, under the roller 44 and on to the take-up reel mounted on member 209. Printing pressure is adjusted by rotating the disc 148 to give an appropriate setting with the aid of eccentric sleeve 146 and the screw and nut assembly 202 is adjusted to take into account the label length.

The cams 38, 40 serve to index the label web through the over-printer by a pre-set amount and a fine adjustment is provided by the claw member 96 which is mounted in the slot 242 of the plate 230. The claw tip engages a cut between individual labels or a transverse edge of a label or perforations between two labels in order to move that label to give a precise location relationship with the type on the drum. Indexing can be made precise by adjusting the position of the claw member in the slot 242. It will be appreciated that any slight inaccuracy which would be insignificant in relation to one label would become a major problem with the passage of thousands of labels.

The invention therefore provides an indexing mechanism for a label web including main means for indexing the web past a station and auxiliary, rectification, means for indexing labels an additional distance to bring them to a precise location at the station. The main indexing means, has, as will be appreciated from the foregoing description a rotary action provided by the cams 38, 40 and the auxiliary means has a reciprocatory action provided by the claw 96.

The setting of the various parts can readily be monitored by operating the machine manually with the aid of the handle which can engage in the bore and slot 220, 222 of the type drum.

Major adjustment can be assisted by rotating the type drum through the agency of a knurled disc 73 (FIG. 1) having apertures 75 to accommodate end portions of adjustable facet print mechanisms engaged in the bores 110 of the drum.

When driven the labels are synchronised to the rotation of the type drum and the claw reciprocates from leading edge to leading edge of successive labels. Under these mormal operational conditions the pad of the drag brake 30 will be in frictional engagement with the labels and the counter provides an exact read-out of the through-put. A transparent cover may be provided and is partly indicated at 41 in FIGS. 1 and 2.

I claim:

1. In a label over-printer a label web reel holder, a frame of the over-printer mounting the reel holder, guide means for guiding the label web from the reel, said guide means being adjustable and adjacent one edge of the web, a releasable brake pad operative on the upper face of the label web as it is drawn from the reel through the guide means, a printing mechanism downstream of the guide means including a rotary type drum having extruded groups of rails for receiving printing indicia accommodated in at least one axially extending recess in the periphery of the drum, a rotary platen freely-rotatable and co-operating with the type drum, means eccentrically mounting the platen whereby printing pressure between the type drum and the platen can be adjusted, cam means secured for rotation and co-axial with the type drum, further cam means synchronously driven in the opposite sense of the cam means of the type drum and arranged to co-operate therewith to index the web intermittently through the printing mechanism, and an ink roller co-operating with said printing indicia, said roller incorporating a multiplicity of discs of ink-absorbent paper arranged as a stack, and means at each end of the stack clamping the discs together, reciprocating indexing means for providing fine adjustment of the indexing stroke of the label web through the over-printer, guide rollers operable on the printed web of labels after the printing mechanism, a web take-up reel mounted on the frame after the said guide rollers, and means for positively driving said take-up reel to wind the printed web on the reel.

* * * * *